US010989385B2

(12) United States Patent
Seidl et al.

(10) Patent No.: US 10,989,385 B2
(45) Date of Patent: Apr. 27, 2021

(54) LIGHTING DEVICE, PREFERABLY WITH ADJUSTABLE OR ADJUSTED COLOR LOCATION, AND USE THEREOF, AND METHOD FOR ADJUSTING THE COLOR LOCATION OF A LIGHTING DEVICE

(71) Applicant: Schott AG, Mainz (DE)

(72) Inventors: Albrecht Seidl, Niedernberg (DE); Volker Hagemann, Nieder-Olm (DE); Edgar Pawlowski, Stadecken-Elsheim (DE); Frank Gindele, Schweitenkirchen (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 16/676,670

(22) Filed: Nov. 7, 2019

(65) Prior Publication Data

US 2020/0141551 A1 May 7, 2020

(30) Foreign Application Priority Data

Nov. 7, 2018 (DE) ..... 10 2018 127 831.4

(51) Int. Cl.
*F21S 41/16* (2018.01)
*F21K 9/69* (2016.01)
*F21Y 115/30* (2016.01)

(52) U.S. Cl.
CPC ..... *F21S 41/16* (2018.01); *F21K 9/69* (2016.08); *F21Y 2115/30* (2016.08)

(58) Field of Classification Search
None
See application file for complete search history.

(56) References Cited

U.S. PATENT DOCUMENTS 9,366,413 B2 6/2016 Rehn
2012/0106178 A1* 5/2012 Takahashi ..... F21V 9/40 362/459

(Continued)

FOREIGN PATENT DOCUMENTS

CN 106939991 A 7/2017
DE 10 2012 223 854 A1 6/2014

(Continued)

OTHER PUBLICATIONS

"Intelligent Lighting Designs Enabled by Laser Light", Julian A. Carey and Dr. Paul Rudy, LED Professional, Issue 63, Sep./Oct. 2017, pp. 66-70 (7 pages).

(Continued)

*Primary Examiner* — Ashok Patel
(74) *Attorney, Agent, or Firm* — Taylor IP, P.C.

(57) ABSTRACT

A lighting device includes: at least one laser light source configured to emit a light beam; and a light conversion element associated with the at least one laser light source and arranged in the beam path of at least one light beam generated by at least one laser light source such that at least a portion of the light beam emitted by the at least one laser light source is directed onto the light conversion element, and in such a way that a laser light spot is illuminated on a face of the light conversion element facing the incident light beam, the light conversion element comprising a material which, through scattering, absorption and conversion of the incident laser light, emits and scatters light of a larger wavelength.

20 Claims, 9 Drawing Sheets

(56) References Cited

U.S. PATENT DOCUMENTS

| | | | | |
|---|---|---|---|---|
| 2012/0106189 | A1* | 5/2012 | Takahashi | F21S 41/663 362/538 |
| 2012/0275174 | A1* | 11/2012 | Takahashi | H01S 5/005 362/487 |
| 2013/0308332 | A1* | 11/2013 | Woelfing | G03B 21/204 362/553 |
| 2015/0329778 | A1 | 11/2015 | Menke et al. | |
| 2017/0198876 | A1 | 7/2017 | Boinet | |
| 2017/0210277 | A1 | 7/2017 | Harada et al. | |
| 2017/0210280 | A1 | 7/2017 | Suzuki | |
| 2019/0179218 | A1 | 6/2019 | Jagt et al. | |

FOREIGN PATENT DOCUMENTS

| | | | |
|---|---|---|---|
| EP | 3 184 884 | A1 | 6/2017 |
| EP | 3 203 140 | A1 | 8/2017 |
| WO | 2017/104167 | A1 | 6/2017 |
| WO | 2017/111405 | A1 | 6/2017 |
| WO | 2017/133809 | A1 | 8/2017 |

OTHER PUBLICATIONS

"Revised Kubelka-Munk theory. II Unified framework for homogeneous and inhomogeneous optical media", Yang et al., J. Opt. Soc. Am A, vol. 21, No. 10, Oct. 2004, pp. 1942-1952 (11 pages).

* cited by examiner

LIGHTING DEVICE, PREFERABLY WITH ADJUSTABLE OR ADJUSTED COLOR LOCATION, AND USE THEREOF, AND METHOD FOR ADJUSTING THE COLOR LOCATION OF A LIGHTING DEVICE

BACKGROUND OF THE INVENTION

1. Field of the Invention

The present disclosure relates to a lighting device, a lighting device with an adjustable or adjusted color location, to its use, and to a method for adjusting the color location of a lighting device.

2. Description of the Related Art

Various lighting devices are known from the prior art, for example so-called discharge lamps and halogen lamps. For various reasons, however, lighting devices based on laser light sources are of increasing interest, for example in terms of energy efficiency or in order to provide lighting devices of small installation size and preferably at the same time high luminance. Such lighting devices are usually configured so as to comprise at least one laser light source, such as a laser diode, and a light conversion element. The latter is necessary because the light emitted by the laser light source or laser light sources does not have the desired color location such as a color-neutral "white" color location. When irradiated with the light of the laser light source(s), which is usually monochromatic, the light conversion element is able to partially or completely convert it into one or more other wavelengths or into a specific spectrum of wavelengths, so that through additive color mixing of the scattered light and the converted light a light image can be generated that exhibits the desired or specified color location. The light conversion element is also referred to as a converter, luminescent element or phosphor, wherein the term "phosphor" must not be understood here in the sense of the chemical element of similar name but rather refers to the property of these substances to luminesce. For the purposes of the present disclosure, unless explicitly stated otherwise, the term "phosphor" is therefore understood to mean a luminescent substance, rather than the chemical element of similar name.

Such lighting devices based on laser light sources are of particular importance in particular because high luminance can be achieved in this way, which is particularly important for applications in the automotive sector, for example. The goal here is to achieve particularly high luminance even at low laser power, in order to not only achieve a high luminance, but also keep energy consumption as low as possible. This may be achieved by producing a light spot of only small dimension, for example of only a small diameter, but with a respective high luminance.

German patent application publication DE 10 2012 223 854 A1 describes a remote phosphor converter apparatus which comprises a holder and a converter element held by this holder, and a primary light emitter element which is configured to direct primary light emitted thereby onto the converter element.

US patent application US 2017/0210277 A1 discloses a semiconductor LED device in which luminance slightly decreases in a longitudinal direction thereof.

US patent application US 2017/0210280 A1 discloses a headlight device for vehicles, which is configured so as to be capable of outputting various light distribution pattern with low power consumption.

US patent application US 2017/0198876 A1 discloses a lighting device which is equipped with a curved light conversion element, and a vehicle headlight comprising such a lighting device.

European patent application EP 3 184 884 A1 discloses a method for controlling a motor vehicle headlight and a corresponding motor vehicle headlight. The motor vehicle headlight comprises at least one laser diode and a light conversion element associated with the laser diode. Regions of the light conversion element corresponding to different portions of the light image can be illuminated periodically and with different intensity by a light beam of the laser diode, so that the illumination intensity in different portions of the light image can be adjusted by the relative illumination duration and/or by the different light intensities of the laser diode in these regions.

International patent application WO 2017/133809 A1 describes an illumination device for emitting illumination light. The illumination device comprises an LED for emitting LED radiation, and a laser for emitting laser radiation, and a luminescent element for at least partial conversion of the LED radiation and the laser radiation into conversion light. During operation of the illumination device, the areas on the luminescent element on which LED light or laser light is irradiated overlap at least partially.

European patent application EP 3 203 140 A1 discloses a lighting device for a vehicle and an associated operating method. The lighting device comprises a pixel light source and an anamorphic element that can be irradiated by the pixel light source at least partially with a light distribution.

Chinese patent application CN 106939991 A discloses a vehicle headlight based on laser excitation of a fluorescent optical fiber, comprising a laser module, an optical fiber, and a fluorescent optical fiber. In this way, a vehicle headlight of compact configuration is provided.

International patent application WO 2017/111405 A1 discloses a phosphor plate package, a light-emitting package, and a vehicle headlight comprising such packages.

International patent application WO 2017/104167 A1 discloses an illumination device and a vehicle headlight. The illumination device comprises a light emitting unit having a phosphor which emits light when being excited by light of the laser element, and a moveable mirror continuously moving according to a predetermined rule.

Lighting design options using laser light are furthermore described by Carey and Rudy, LED professional 63, 2017, pages 66-70.

However, it has been found that, in fact, lighting devices based on laser light sources are capable in this way to achieve high luminance of the light spot generated by the lighting device with low energy consumption when compared to lighting devices of the prior art, but that significant deviations of the predicted color location from the expected color location may occur with regard to the color location of the generated light image. When using "blue" laser light sources, that is to say laser light sources which generate blue light, an excessive blue content might result in the generated light image, for example in the case of particularly high luminances of the light spot produced by the lighting device due to particularly strong focusing of the laser beam. As a consequence of this deviation, standardized statutory requirements with regard to the color location such as existent in the automotive sector with regard to the color location of headlights, for example, might not be met by such lighting devices based on laser light sources featuring a particularly high luminance. What is relevant here is the so-called H—V value at which the color location of the light image is determined at a distance of 25 m from the lighting device. If possible, this H—V value should be in the "white" field of the relevant ECE regulations. However, the aforementioned deviation ultimately influences all lighting devices that are based on laser light conversion, in particular on the conversion of blue laser light.

What is needed in the art is lighting devices which at least mitigate the deficiencies of the prior art mentioned above.

SUMMARY OF THE INVENTION

Exemplary embodiments provided according to the disclosure include a lighting device, which may be a lighting device with adjustable or adjusted color location or color temperature, which comprises at least one laser light source and a light conversion element associated with the at least one laser light source or the laser light sources. The laser light source(s) is/are operable for generating a light beam. The light conversion element is arranged in the beam path of at least one light beam generated by at least one laser light source.

In some exemplary embodiments disclosed herein, a lighting device includes: at least one laser light source configured to emit a light beam; and a light conversion element associated with the at least one laser light source and arranged in a beam path of at least one light beam generated by the at least one laser light source such that at least a portion of the light beam emitted by the at least one laser light source is directed onto the light conversion element, and in such a way that a laser light spot is illuminated on a face of the light conversion element facing the incident light beam. The light conversion element comprises a material which, through scattering, absorption and conversion of the incident light beam, emits and scatters light of a larger wavelength. A primary emission light spot of light having the same wavelength as a wavelength of the incident light beam is produced on the face of the light conversion element facing the incident light beam, the spot being larger than the laser light spot, and a secondary emission light spot of light having a larger wavelength. The secondary emission light spot is larger than the primary emission light spot. A used light spot that is exploited for the lighting device comprises only a portion of the secondary emission light spot.

In some exemplary embodiments disclosed herein, a method of adjusting a color location or a color temperature of a lighting device is provided. The method includes the steps of: providing a lighting device that comprises at least one laser light source, a light conversion element associated with the at least one laser light source, and optics forming and directing laser radiation onto the light conversion element, the light conversion element being arranged in a beam path of a light beam generated by the at least one laser light source; generating at least one light beam emitted by the at least one laser light source; directing at least a portion of the at least one light beam generated by the laser light source onto the light conversion element such that a laser light spot as an image of a portion of the light beam emitted by the laser light source and directed to the light conversion element is illuminated on a face of the light conversion element facing the incident light beam, the laser light spot having a dimension of at least 5 μm and at most 1000 μm, a portion of the incident laser light being backscattered by the light conversion element without undergoing conversion so that a primary emission light spot of light having the same wavelength or color as the laser light is produced on the face of the light conversion element facing the incident light beam, which spot is larger than the laser light spot, the light conversion element partially converting the light emitted by the laser light source into light of a longer wavelength such that a secondary emission light spot of a larger wavelength is produced on the face of the light conversion element facing the incident light beam, which secondary emission light spot is larger than the primary emission light spot; generating a light image by the primary emission light spot and the secondary emission light spot by directing a portion of radiation emitted by the primary emission light spot and the secondary emission light spot onto at least one of at least one optical element or at least one optical component, a selected used light spot being smaller than the secondary emission light spot; determining an integral color location or color temperature for a selected portion of the light image produced by at least one of the at least one optical element or the at least one optical component or of a selected light bundle; and adjusting the color location by at least one of: (a) adjusting a primary luminance distribution and a secondary luminance distribution of the emission light spot resulting on the light conversion element through the size of the laser light spot produced by at least a portion of the at least one light beam emitted by the at least one laser light source; (b) adjusting a primary luminance distribution and a secondary luminance distribution of the emission light spot resulting on the light conversion element by adapting absorption and scattering properties of the material of the conversion element; (c) adjusting an imaged area portion of the emission light spot by adapting downstream imaging optics; or (d) selecting an illuminated portion of the considered light beam by partial blanking downstream of imaging optics.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
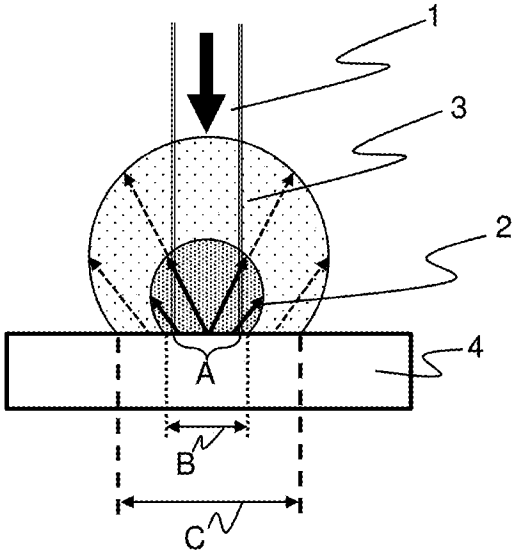
FIG. 1 is a schematic diagram illustrating light spreading.

The following definitions shall apply in the context of the present disclosure:

Laser Light Source

In the context of the present disclosure, a laser light source such as a laser diode (also referred to as a semiconductor laser) is understood to mean a source of electromagnetic radiation, such as a semiconductor device, which generates laser radiation, i.e. electromagnetic radiation, within a narrow frequency range. Laser light sources that are of importance in the context of the present disclosure generate laser radiation with wavelengths in the range of visible light (wavelengths from about 380 nm to about 780 nm). Of particular importance are those laser light sources which produce blue light (wavelengths from about 380 nm to about 465 nm).

Color Location and Color Temperature

The color location of a body or a light source, so for example the color location of the light generated by a lighting device, describes the color impression caused by the body or by the light source. The color location is described here by its location in the CIE standard color chart, i.e. by the cx and cy coordinates.

The color temperature of a light source is the temperature of a black radiator (or Planck radiator) whose color impression is most similar to the respective color impression.

When adjustability of the color location is discussed in the context of the present disclosure, this is to be understood as meaning that the light generated by the lighting device can be modified with regard to the color impression experienced by the viewer, that is to say with regard to the values of the cx and cy coordinates in the CIE standard color chart mentioned above.

In the context of the present disclosure, adjusted color location is understood to mean that the color location of a lighting device is adapted to a predefined color location, for example so as to correspond to a certain color location or color location window such as defined by statutory requirements, for example by adapting the spatial-physical design of the lighting device. This can be done, for example, by adapting the geometric arrangement of the components of such a lighting device and/or by adapting the components of such a lighting device, for example by replacing a light conversion element by a different one that has different properties than the replaced light conversion element, for example in terms of the scattering coefficient.

Light Conversion Element

For the purposes of the present disclosure, a light conversion element is understood to mean an element which comprises a phosphor, that is to say which is composed thereof, for example, or contains or includes it or is coated with such a phosphor. For the purposes of the present disclosure, the terms "luminescent substance" or "phosphor" refer to those substances which, when irradiated with electromagnetic waves such as in the form of visible light or UV radiation, are capable of converting it into electromagnetic radiation of a higher wavelength. For example, cerium-doped so-called yttrium aluminum garnet is known to be a "yellow" phosphor. When irradiated with blue light (such as produced by an indium gallium nitride laser), a portion of the irradiated radiation is converted into light of a longer wavelength with a focus in the green-yellow spectral range and is re-emitted.

The terms "light conversion element" and "conversion element" will be used synonymously in the context of the present disclosure. The terms "converter" and "converter element" are used as well for the light conversion element.

Arrangement in the Beam Path

When the light conversion element is referred to as being arranged in the beam path in the context of the present disclosure, this is to be understood to mean that the light from the laser light source(s) is directed onto the conversion element. This can be achieved in a conventional way, for example, by arranging the conversion element in the beam path of the laser. However, it is also possible for the light beam to be formed and/or deflected by one or more optical elements and/or optical components such as optical lenses, mirrors, and/or optical fibers so that it is irradiated onto the conversion element. In particular, "located in the beam path of the laser light source(s)" is also understood to mean that the light of the laser light source(s) is directed onto the conversion element through one or more optical fibers. The light beam may be incident on the conversion element perpendicularly or at a certain angle. It is also possible that a plurality of light beams are incident in the same place of the light conversion element from different directions. What is decisive according to embodiments provided according to the disclosure is that one or more laser beams emanating from one or more laser light source(s), for example blue laser beams, are incident on the light conversion element and produce a laser light spot there.

Laser Light Spot (Illumination Spot, Laser Spot)

At least a portion of the laser light beam or of a plurality of laser light beams is directed onto the light conversion element such that a laser light spot of a specific size is illuminated on the light conversion element. In some embodiments, this is done by at least one optical element and/or optical component arranged between the laser light source(s) and the light conversion element. This may in particular also be an optical fiber, or a plurality of optical fibers having a respective light exit side at a certain distance from the light conversion element. The laser light spot may as well be produced by a plurality of laser light beams being incident from different spatial directions. The laser light spot may have an axially symmetrical, elliptical, or else an arbitrarily shaped form.

The laser light spot illuminated on the light conversion element by the incident light beam may have a dimension such as a diameter, such as an FWHM diameter, of at least 5 μm and at most 1000 μm. The radial intensity profile of the laser light spot may be any, such as "Gaussian" or "top hat" or another profile as created by appropriate beam forming. More generally, a laser light spot is described by its intensity distribution I(x, y) [$W/m^2$].

Primary Emission Light Spot

The primary emission light spot (also referred to as "blue emission spot" below by way of example in conjunction with some embodiments) is resulting from diffuse reflection and backscattering (also referred to as remission below) of a portion of the incident laser light which is not converted nor absorbed. The primary emission light spot is always slightly larger than the laser light spot, since the laser light (which is blue in the embodiment considered here) penetrates into the light conversion element, where it is not only absorbed or converted, but also scattered to some extent and partly exits from the surface of the light conversion element without having been absorbed or converted. The described scattering also occurs radially, so that the primary emission light spot becomes slightly larger than the spot of incident laser light.

This expansion effect is referred to as "light spreading" and may also be referred to as "spreading" of a laser spot.

Secondary Emission Light Spot

The secondary emission light spot (referred to as "yellow emission spot" below by way of example in conjunction with one embodiment) is resulting from absorption and partial conversion of that portion of the incident laser light which is not remitted. The converted light has a larger wavelength than the laser light, or it is converted into visible light exhibiting a specific spectrum. The secondary emission light spot is even larger than the primary emission light spot, since the converted light of larger wavelength is absorbed only very weakly and is able to propagate, through lateral scattering, much further in the light conversion element than the laser light (which is blue in the embodiment considered here) before exiting from the light conversion element. This expansion effect is again referred to as "light spreading".

Light Spreading

The light spreading described above is therefore dependent on the absorption and scattering properties of the light conversion element, and thus on the wavelength of the light considered. In the exemplary case of cerium-doped yttrium aluminum garnet as the light conversion element, yellow light exhibits more light spreading than blue light because it is not so strongly absorbed.

Used Light Spot

The portion of the emission light spot that is used by a lighting device is determined by imaging optics, apertures and the like. For example, the used light spot may be smaller than the emission light spot, by masking out peripheral areas.

Absorption and Scattering Properties

The absorption and scattering properties of the light conversion element are described by the (wavelength-dependent) absorption coefficient a [$cm^{-1}$] and the (wavelength-dependent) scattering coefficient s [$cm^{-1}$]. Here and below, the two parameters are understood to be defined such that a describes the attenuation of a light beam by absorption in a (hypothetically) purely absorbing, non-scattering material of a specific thickness t, by the relationship $I=I_0*\exp(-a*t)$, and s describes the attenuation of a light beam by scattering in a (hypothetically) purely scattering, non-absorbing material of a specific thickness t, by the relationship $I=I_0*\exp(-s*t)$. $I_0$ and I are the peak intensities of the primary beam and the attenuated beam, respectively. So, a and s are material parameters. In reality, a light conversion element has both absorbing and scattering properties and is therefore described in terms of its absorption and scattering properties by indicating both parameters.

The measurable attenuation of a light beam in a (real) both absorbing and scattering material of a specific thickness cannot explicitly be described but only approximately, for example by the so-called Kubelka-Munk theory (see, for example, Yang et al., J. Opt. Soc. Am A, Vol. 21, 2004, pages 1942-1952). For the absorption and scattering properties of the material of a light conversion element described herein, the following relationship of Yang 2004 was used, which describes the attenuation of a light beam that is transmitted through an at the same time absorbing and scattering medium:

$$I = I_0 \cdot (1 - r_0) \cdot (1 - r_1) \cdot \frac{(1 - R_{inf}^2) \cdot e^{b \cdot S \cdot D}}{(1 - R_{inf} \cdot r_1)^2 - (R_{inf} - r_1)^2 \cdot e^{-2 \cdot b \cdot S \cdot D}}$$

with $$R_{inf} = 1 + \frac{K}{S} - \sqrt{2 \cdot \frac{K}{S} + \left(\frac{K}{S}\right)^2}$$

and $$b = \frac{1 - R_{inf}^2}{2 \cdot R_{inf}}$$

wherein the connection to the material properties a and s is given by $$K = 2 \cdot a$$

and $$S = s$$

where $r_0$ and $r_1$ denote the reflectivity of the front and rear faces and D is the thickness of the sample. By measuring the transmission on samples of the same material but of different thickness, it is possible to determine s and a.

Light conversion elements provided according to exemplary embodiments of the present disclosure are characterized by the fact of exhibiting different absorption and scattering coefficients for the laser light (the primary light) and the converted light (the secondary light). For the primary light, a is about >10 $cm^{-1}$, better a>50 $cm^{-1}$, and 5 $cm^{-1}$<s<500 $cm^{-1}$, depending on whether much or little directly remitted light is desired, for example directly remitted blue light. For the secondary light, a should be as small as possible: a<10 $cm^{-1}$, better a<1 $cm^{-1}$, and s should always be as high as possible: s>10 $cm^{-1}$, better s>50 $cm^{-1}$.

Luminance Distribution and Distribution of Color Location of the Light Source

The radiation of a light source is completely described by the spectral luminance thereof. In the case of a Lambert radiator, the luminance L [$lm/sr \cdot m^2$] does not depend on the emission angle. In the case of the light conversion elements considered here, for example a light conversion element based on Ce:YAG for a gallium indium nitride-based laser, the assumption of a Lambert radiator is very well met. The "light spreading" as described above together with the size or intensity distribution I(x,y) of the laser light spot therefore leads to more or less different luminance distributions L(x,y) of the primary and secondary emission light spots. If one considers both light spots superimposed, a location dependency of the color location is resulting, i.e. a distribution of color location. In the embodiment considered here, the blue fraction is higher in the center, but weaker towards the periphery. Thus, for a specific conversion material (for example Ce:YAG) the location-dependent color location ultimately depends on the dimension, for example on the FWHM diameter of the laser spot and on the absorption and scattering properties a and s of the light conversion element. Correspondingly, the integral color location of a used light spot also depends on the same properties and dimensions if it is smaller than the emission light spot.

Luminance and Color Location at the Measurement Position

Usually, a light source having a given luminance and luminance distribution is used as a light source in an optical illumination system. This may be a headlight illuminating a road, for example. An optical illumination system is characterized by its light conductance G [sr·m$^2$] which describes how light is conveyed from the area element $A_1$ of the light source to the illuminated area element $A_2$ located at a distance r. For the Lambert radiator and for a large distance r, the luminous flux Φ[lm] conveyed from $A_1$ to $A_2$ is given by Φ=L*G, wherein L is the average luminance of the area $A_1$. Here, the area $A_1$ may be a small portion in the center of the light spot on the light conversion element, and the area $A_2$ may be the capturing area of a detector in the H—V point of a headlight testing device.

Since according to one considered embodiment the luminance distributions L(x,y) are different for blue light and yellow light, for example, more generally for light of different wavelengths, and can be influenced by the material parameters a and s or the intensity distribution of the laser spot (x,y), it is also possible to adjust the ratio of yellow and blue luminous flux and thus the resulting color location, for example at the test point of a headlight testing device, namely through material parameters, or through the distribution of irradiance intensity, or through the aperture of the headlight optics.

Another example that shall be mentioned is the illumination of the input area $A_2$ of an optical fiber, into which light from an area portion $A_1$ of the light conversion element is injected. By modifying the injecting optics it is possible to vary the captured area $A_1$ of the emission light spot, or by modifying the intensity distribution of the laser spot it is possible to vary the average light color in the area $A_1$. In this way, it is possible to adjust the color of the light subsequently emerging from the fiber.

According to the present disclosure, there is thus provided a lighting device, which may be with an adjustable or adjusted color location or color temperature, which comprises at least one laser light source and a light conversion element associated with the at least one laser light source or the laser light sources. The laser light source(s) is/are operable for emitting a light beam; and the light conversion element is arranged in the beam path of at least one light beam or of light beams generated by at least one laser light source; such that at least a portion of the light beam emitted by the at least one laser light source (or the laser light sources) is directed onto the light conversion element, such as by at least one optical element and/or optical component arranged between the at least one laser light source (or the laser light sources) and the light conversion element, and in such a way that a laser light spot, which may be of a predefined size, is illuminated on the face of the light conversion element facing the incident light beam. The light conversion element comprises a material which, through scattering, absorption and conversion of the incident laser light emits and scatters light of a larger wavelength. A primary emission light spot of light having the same wavelength as the wavelength of the incident light beam is produced on the face of the light conversion element facing the incident light beam, which spot is larger than the laser light spot, as well as a secondary emission light spot of light having a larger wavelength, the secondary emission light spot being larger than the primary emission light spot. The used light spot that is exploited for the lighting device comprises only a portion of the secondary emission light spot.

According to some embodiments of the lighting device, the laser light spot illuminated by the incident light beam on the light conversion element has a dimension such as a diameter, which may be an FWHM diameter, or a radius, between at least 5 μm and at most 1000 μm. A primary emission light spot is produced which is larger than the laser light spot, and a secondary emission light spot of light having a larger wavelength. The secondary emission light spot is larger than the primary emission light spot. The ratio of the dimensions such as the diameters, in particular of the FWHM diameters of the secondary to the primary emission light spot is between 1.1 and 10, such as between 1.5 and 5 or between 1.8 and 3.

According to some embodiments of the lighting device, the dimension of the used light spot, in particular the diameter of the used light spot, in particular the FWHM diameter of the used light spot is greater than the dimension of the primary emission light spot, in particular the diameter of the primary emission light spot, in particular the FWHM diameter of the primary emission light spot, while it is smaller than the dimension of the secondary emission light spot, in particular the diameter of the secondary emission light spot, in particular the FWHM diameter of the secondary emission light spot.

A particularly small laser light spot will in particular be selected when a particularly high (average) luminance of the used emission spot of 1000 cd/mm$^2$ and more is desired.

The color location of the used light may have coordinates cx and cy within the area enclosed by the following points:

| cx | cy |
|---|---|
| 0.310 | 0.348 |
| 0.310 | 0.382 |
| 0.443 | 0.382 |
| 0.500 | 0.440 |
| 0.500 | 0.440 |
| 0.443 | 0.348 |
| 0.310 | 0.332. |

If the color coordinates characterizing the color location of the light generated by the lighting device according to the CIE standard color chart as described above have values within the abovementioned limits, this is advantageous, since in this way the statutory requirements for specific applications of lighting devices are complied with, for example for vehicle headlights in the automotive sector. However, other cy and/or cx coordinates or a different color location window might also be permissible for other fields of application in which less stringent or other specifications apply regarding the color location of the radiation produced by a lighting device.

According to some embodiments of the lighting device, the color temperature of the used light is between 1500 K and 10,000 K, such as between 3000 K and 10,000 K or between 3000 K and 8000 K.

According to some embodiments, the laser light source is a laser diode having a power of 0.1 W to 10 W. According to some embodiments, the laser light source comprises an arrangement of a plurality of laser diodes whose laser light is entirely or partially bundled by a suitable optical device, with a total power of up to 1000 W. According to some embodiments, the light of one or more laser diodes is divided, by a suitable optical device, into a plurality of laser beams which are incident on the light conversion element from different directions and together produce the laser light spot there.

So, according to some embodiments of the lighting device, the laser light source is a laser diode with a power from 0.1 W to 10 W, or the laser light source comprises an arrangement of a plurality of laser diodes, and the laser light therefrom is entirely or partially bundled by an optical device, and the light of one or more laser diodes may be divided, by an optical device, into a plurality of laser beams which are incident on the light conversion element from different directions and together form the laser light spot there.

According to some embodiments of the lighting device, the radiation that is incident on the conversion element in the laser light spot has a radiation power from 0.1 W to 1000 W, such as a radiation power from 0.5 W to 500 W or a radiation power from 1 W to 100 W.

According to some embodiments of the lighting device, the radiation that is incident on the conversion element within the laser light spot has an intensity from 0.1 $W/mm^2$ to 500 $W/mm^2$, such as from 0.5 $W/mm^2$ to 250 $W/mm^2$ or from 1 $W/mm^2$ to 100 $W/mm^2$.

It should be noted here that the laser power and the size of the light spot produced on the light conversion element are related to each other and determine the luminance and the color location of the light image generated by the lighting device. Thus, it is possible to generate a high luminance of at least 1000 $cd/mm^2$ by increasing the laser power while maintaining a constant size of the emission light spot, or else by reducing the laser light spot produced by the incident light beam on the light conversion element while keeping constant the laser power. However, as a consequence of the "light spreading" of the primary and secondary radiation as described above, the secondary emission light spot cannot be minimized to any desired size and will in particular become larger relative to the size of the primary emission light spot with increasing focusing of the laser beam, so that the color location of the light image generated by lighting device shifts towards shorter wavelengths, whereas the increase in laser power adversely affects the energy consumption and is possible only within certain limits for this reason. Furthermore, due to the effect known as thermal quenching, the conversion element is able to effectively convert light only up to a certain intensity of the laser radiation. However, this effect shall not be considered further here.

According to some embodiments, the light conversion element has a thickness between at least 10 μm and at most 1000 μm, such as from 20 μm to 500 μm or from 50 μm to 250 μm.

In some embodiments, the laser light source emits electromagnetic radiation of a wavelength within the range between at least 380 nm and at most 470 nm, such as radiation of a wavelength from 400 nm to 470 nm or between 440 nm and 470 nm.

According to some embodiments, the light conversion element has an absorption coefficient a for the laser light of at least 10 $cm^{-1}$, such as of at least 50 $cm^{-1}$. The scattering coefficient s for the laser light is between 5 $cm^{-1}$ and 500 $cm^{-1}$, such as between 20 $cm^{-1}$ and 100 $cm^{-1}$. By contrast, the absorption coefficient a of the light conversion element for the converted light is less than 10 $cm^{-1}$, such as less than 1 $cm^{-1}$. The scattering coefficient s for the converted light should be greater than 20 $cm^{-1}$, such as greater than 50 $cm^{-1}$ or greater than 80 $cm^{-1}$.

So, according to some embodiments of the lighting device, the light conversion element has an absorption coefficient a for the laser light of at least 10 $cm^{-1}$, such as at least 50 $cm^{-1}$, and has a scattering coefficient s for the laser light between 5 $cm^{-1}$ and 500 $cm^{-1}$, such as between 20 $cm^{-1}$ and 200 $cm^{-1}$, and may have an absorption coefficient a for the converted light of less than 10 $cm^{-1}$, such as less than 1 $cm^{-1}$, and a scattering coefficient s for the converted light of more than 20 $cm^{-1}$, such as more than 50 $cm^{-1}$ or more than 80 $cm^{-1}$.

In some embodiments, the light conversion element comprises a luminescent ceramic material. In the context of the present disclosure, this means that the light conversion element may, for example, consist predominantly, that is to say of at least 50 wt %, or substantially, that is to say of at least 90 wt %, of a luminescent ceramic material. It is also possible that the light conversion element consists entirely of the luminescent ceramic material. So, therefore, the light conversion element in particular comprises or consists of a luminescent ceramic material. The light conversion element may also be made of a composite material, for example in the form of a phosphor-in-glass composite, or in the form of a phosphor-in-silicone composite, and in this case it may comprise at least 10 wt % of a luminescent ceramic material, for example between 10 wt % and 30 wt %, in particular between 10 wt % and 20 wt %. According to some embodiments of the lighting device, the light conversion element comprises or consists predominantly, that is of at least 50 wt %, or substantially, that is of at least 90 wt %, or entirely of a garnet-like ceramic material as the luminescent ceramic material. The garnet-like ceramic material may have the following molecular formula:

$A_3B_5O_{12}$:RE, wherein

A comprises Y and/or Gd and/or Lu, and
B comprises Al and/or Ga,
and wherein RE is selected from the group of rare-earth elements and may comprise Ce and/or Pr.

According to some embodiments of the lighting device, the garnet-like ceramic material has the following molecular formula:

$(Y_{1-x}Ce_x)_3Al_5O_{12}$ and/or $(Y_{1-x-y}Gd_yCe_x)_3Al_5O_{12}$ and/or $(Lu_{1-x}Ce_x)_3Al_5O_{12}$ and/or $(Y_{1-x-z}Lu_zCe_x)_3Al_5O_{12}$, with the following conditions applying to x: $0.005<x<0.05$, and to y: $0<y<0.2$, and
to z: $0<z<1$ in each case.

According to some embodiments of the lighting device, the light conversion element comprises a luminescent ceramic material or consists predominantly thereof, i.e. of at least 50 wt %, or substantially, i.e. of at least 90 wt %, or completely, wherein the light conversion element is in the form of

- a single-phase solid ceramic, and/or
- a multi-phase solid ceramic, and/or
- a single-phase or multi-phase ceramic of a specific porosity, and/or
- a composite material, such as a phosphor-in-glass composite (PiG) and/or a phosphor-in-silicone composite (PiS).

According to some embodiments, the ceramic material also comprises other oxidic compounds (besides garnet compounds), and also nitridic compounds, in particular from the group of aluminum oxynitrides and silicon aluminum oxynitrides.

According to some embodiments of the lighting device, the light conversion element is in the form of a porous sintered ceramic and the porosity is between 0.5% and 10%, such as between 4% and 8%. The porosity is based on the volume, here. In some embodiments, the average pore size is between 400 μm and 1200 μm, such as between 600 μm and 1000 μm or between 600 μm and 800 μm.

This means that according to a further aspect of the disclosure it is possible to produce a light image with a color location that is variably adjustable and/or is adjusted even without changing the constituent components of the lighting device, that is to say in particular using the same or at least a similar laser light source and/or using the same or at least a comparable light conversion element. This is achieved in a surprisingly simple manner by varying the size of the light spot generated on the conversion element.

This surprisingly simple method for adjusting, in particular also for optimizing or adapting in a customized or application-specific manner the color location of a lighting device as described herein is based on the finding that light spreading occurs upon irradiation of a light conversion element.

For example, in the case of blue laser light as generated by a gallium nitride laser and/or an indium-gallium nitride laser, for example, which is incident on a light conversion element that is often referred to as a "yellow phosphor" (usually a Ce-doped yttrium aluminum garnet), only a small deviation of the blue light radiance from a Gaussian distribution will be caused, but a much greater deviation of the radiance with respect to the yellow radiation generated by the light conversion element. As a result, the blue radiation fraction will dominate in the center of the light spot and the light generated by the lighting device will overall be excessively bluish.

The spreading of the light is wavelength-dependent and depends in particular on the scattering of the light within the light conversion element itself and—albeit to a lesser extent—on the absorption of the electromagnetic radiation by the light conversion element. So, it has been observed that the light generated by the light conversion element by converting the radiation as generated by the laser light source and directed onto the light conversion element is scattered more strongly in the light conversion element. This causes the already described deviation of the radiance distribution from an ideal Gaussian profile. The effect can also be described illustratively as a "dilution" of the yellow light component.

However, the described effect is by no means limited to the use of a blue laser in conjunction with a so-called yellow phosphor. Rather, the effect described occurs in different materials and at different wavelengths.

In particular, the light scattering also occurs in phosphors that are provided in the form of a phosphor-in-glass (PiG) composite and/or as a phosphor-in-silicone (PiS) composite.

However, the magnitude of this effect scales with the size of the (laser) light spot. The smaller it is, the more the light spreading is pronounced and the more the color location of the light generated by the lighting device shifts into the blue. Thus, by reducing the size of the light spot, it is possible to produce light with a more "blue" color impression. A more "yellow" color location of the generated light is accordingly obtained by a large light spot. In fact, this is accompanied by an alteration in luminance, since small light spots are in particular advantageous because they allow to achieve particularly high luminance at relatively low laser powers. However, the laser power can be varied too, so that it is easily possible, in particular without replacing any components, to consistently match color locations and luminances between different lighting devices merely by varying the size of the light spot and adjusting the laser power.

In some exemplary embodiments disclosed provided according to the present disclosure, a method for adjusting the color location or color temperature of a lighting device comprises the steps of:

providing a lighting device comprising at least one laser light source, such as for blue laser radiation, and a light conversion element associated with the at least one laser light source, and optics forming and directing the laser radiation onto the light conversion element, wherein the light conversion element is arranged in the beam path of a light beam generated by the at least one laser light source or the laser light sources;

generating at least one light beam emitted by the laser light source or the laser light sources;

directing at least a portion of the light beam generated by the laser light source or laser light sources onto the light conversion element, such as by an optical element and/or optical component arranged between the laser light source(s) and the light conversion element; such that a laser light spot as an image of the portion of the light beam emitted by the laser light source or laser light sources and directed to the light conversion element is illuminated on the face of the light conversion element facing the incident light beam, wherein the laser light spot has a dimension such as a diameter, which may be an FWHM diameter, between at least 5 μm and at most 1000 μm;

wherein, the light conversion element may comprise a material which, through scattering, absorption and conversion of the incident laser light, emits and scatters light of a larger wavelength;

wherein a portion of the incident laser light is backscattered without undergoing conversion by the light conversion element, so that a primary emission light spot of light having the same wavelength or color as the laser light is produced on the face of the light conversion element facing the incident light beam;

wherein the light conversion element partially converts the light emitted by the laser light source or laser light sources into light of a longer wavelength such that a secondary emission light spot of a larger wavelength is produced on the face of the light conversion element facing the incident light beam;

generating a light image by the primary and secondary emission light spots, for example by directing a portion of the radiation emitted by the primary and secondary emission light spots onto at least one optical element and/or optical component;

determining the integral color location for a selected portion of the light image as produced by an optical element and/or optical component, for example, or of the selected light bundle, such as of a light image which is or will be generated at a distance of 25 m from the lighting device; and adjusting the color location or color temperature by (a) adjusting the primary and secondary luminance distribution of the emission light spot resulting on the light conversion element by the size of the laser light spot produced by at least a portion of the at least one light beam emitted by the at least one laser light source; and/or (b) adjusting the primary and secondary luminance distribution of the emission light spot resulting on the light conversion element by adapting the absorption and scattering properties of the material of the conversion element; and/or (c) adjusting the imaged area portion of the emission light spot (i.e. of the used light spot) by adapting the downstream imaging optics; and/or (d) selecting the illuminated portion of the considered light bundle by partial blanking downstream of the imaging optics.

In some embodiments, the power of the incident laser radiation is set between 0.5 W and 1000 W.

According to some embodiment, the use of a lighting device provided according to the present disclosure is disclosed for vehicle headlights or spotlights for stage lighting, or for aircraft headlights or helicopter headlights or vessel headlights or as a signal light, or as searchlights or for stadium lighting or for projectors or for architectural lighting.

Referring now to the drawings, FIG. 1 is a schematic diagram, not drawn to scale, illustrating the light spreading for the example of an illuminated area for a substantially dot-like illumination. Shown is a section through a light conversion element 4 illuminated by a light beam 1.

However, more generally, without being limited to the case of the circular illuminated area assumed here by way of example, the laser light spot may also have a different shape, for example as produced by specific beam forming.

In FIG. 1, the laser light spot on the light conversion element 4 as illuminated by the incident light beam 1 has a dimension A, such as a diameter, which may be an FWHM diameter, of at least 5 μm and at most 1000 μm. Here, the term dimension shall generally be understood to mean that A determines the size of the laser light spot. Usually it can be assumed that the laser light spot has an approximately dot-like or circular shape. However, the invention is by no means limited to such a dot-like or circular illumination, so that other shapes of the laser light spot such as a more square or rectangular shape of the laser light spot are of course possible.

By directing the light beam 1 onto the light conversion element 4, a primary emission light spot of remitted light 2 is produced. The primary emission light spot is larger than the laser light spot. The size of the primary emission light spot is denoted by the dimension B here, which may be the diameter of the primary emission light spot, for example.

Generally, B is greater than A, as can be seen in FIG. 1.

Furthermore, a secondary emission light spot of light having a larger wavelength is resulting, that is of converted light 3. The secondary emission light spot is larger than the primary emission light spot. Here, the size of the secondary emission light spot is denoted by the dimension C, which may be the diameter of the secondary emission light spot, for example.

Generally, as can be seen from FIG. 1 as well, C is larger than B and is thus, accordingly, larger than A.

FIG. 1 illustrates the case of a substantially dot-like illumination of the light conversion element 4 with a light beam 1. The dimensions A, B and C denote the respective diameter here. For the purposes of the present disclosure, dot-like means lighting with a very small diameter, for example of less than 100 μm or even less than 10 μm. In the case of dot-like illumination as illustrated in FIG. 1, the size as characterized by the dimension, here the diameter, A of the laser light spot is smaller than the size as characterized by the dimension, i.e. the diameter, B of the primary emission light spot of remitted light 2 here, which in turn is smaller than the size as characterized by the dimension (i.e. specifically the diameter) C of the secondary emission light spot of the converted light 3.

The expansion effects described are also referred to as light spreading, as mentioned before.

This effect occurs both at the boundaries of illuminated areas and for substantially dot-like illumination (as shown in FIG. 1).

In particular with increasing focusing of the light beam 1, i.e. in the case of a particularly small dimension, so as to achieve high luminance with low energy consumption, the secondary emission light spot is getting larger in relation to the size of the primary emission light spot, thereby shifting the color location of the light image generated by the lighting device to shorter wavelengths. So, the phenomenon of light spreading is very pronounced especially in the case of particularly high luminances that are to be achieved by increasing the focusing of the light beam 1.

This means that, overall, the resultant emitted beam of the light generated by the light conversion element by conversion of the radiation as generated by the laser light source and directed onto the light conversion element is inhomogeneous with regard to the color distribution. In particular, the luminance distribution deviates from an ideal Gaussian profile.

This would be harmless if all emitted radiation were captured. However, most applications only use a portion of the emitted radiation. This results, for example, from the fact that an aperture is arranged in the beam path. In such cases, the color inhomogeneity of the emitted beam is of significance.

Figure 2:
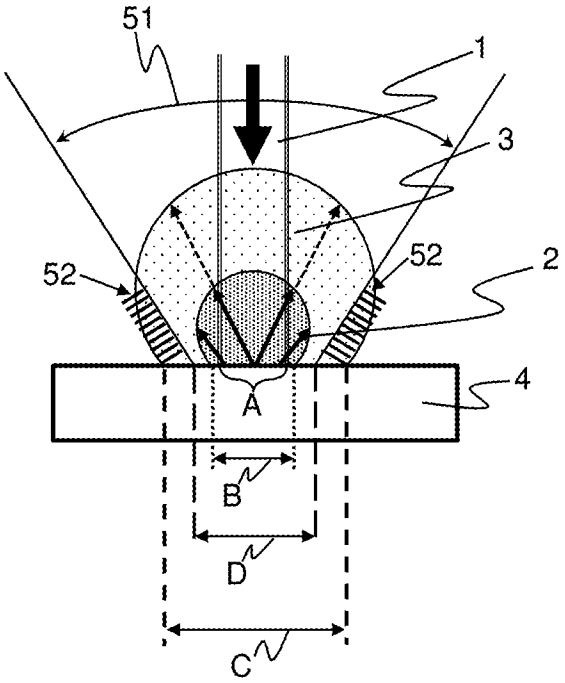
FIG. 2 is a schematic diagram of the effect of light spreading on the imaging by imaging optics.

This is shown in FIG. 2, by way of example, again for the case of the substantially dot-like illumination. In addition to the incident light 1, the remitted light 2, the converted light 3, and the light conversion element 4, the beam portion 51 relevant for the illumination optics and the loss portion 52 are shown.

Figure 3:
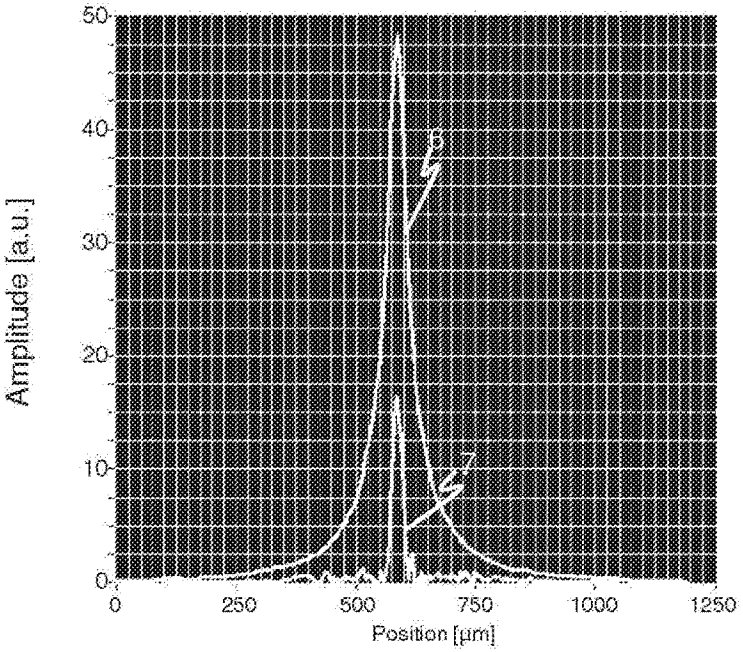
FIG. 3 illustrates the intensities and beam profiles for light of different wavelengths after impingement on a light conversion element.

FIG. 3 shows the intensities and beam profiles for light of different wavelengths after impinging on a light conversion element 4.

Figure 4:
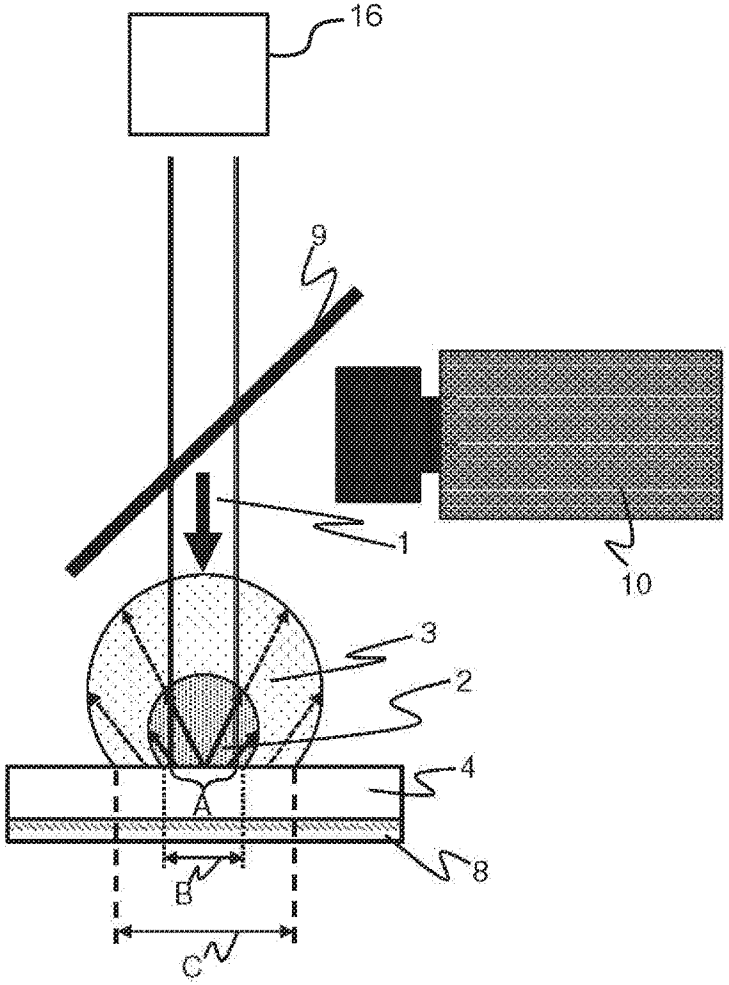
FIG. 4 is a schematic view of a measurement setup for determining light spreading.

The beam profiles depicted in FIG. 3 may be obtained in a measurement setup according to FIG. 4, for example. FIG. 4 shows a schematic measurement setup comprising an RGB camera 10 and a dichroic filter 9. The degree of light spreading was determined by examining the resulting emission light spot on a light conversion element 4, here exemplified in the form of a ceramic converter. The light beam 1 examined here was from a laser light source 16 based on indium gallium nitride, so that consequently the light beam 1 was a blue light beam. Again, the dimensions A, B, and C denote the respective diameters here, and reference numeral 2 denotes the remitted light, and 3 the converted light. By way of example, for the case of the incident "blue" light considered here, with a diameter of the laser light spot of 80 μm in this case, the remitted light 2 is likewise "blue" light here. The converted light 3 is "yellow" light here, by way of example, resulting from the conversion of the blue light at an appropriate light conversion element 4 which comprises Ce-doped YAG, for example. The light conversion element 4 is arranged on a mirror plate 8 here.

For this case, the beam profiles shown in FIG. 3 are obtained, by way of example. On the y-axis, the intensity is plotted in arbitrary units, on the x-axis the position in μm. Profile 6 is obtained for the converted light 3, intensity profile 7 for the remitted light 2. It can clearly be seen that the fraction of converted light 3, in this case the "yellow" light, dominates at the beam edges. In sum, this results in an emission light spot having an elevated fraction of remitted light in the center of the light spot and a comparatively increased fraction of converted light at the periphery of the light spot.

For the case under consideration here, namely a substantially dot-like illumination with blue light and the conversion into yellow light, a beam is resulting which is "too blue" in the center, but "too yellow" at the periphery.

Figure 5:
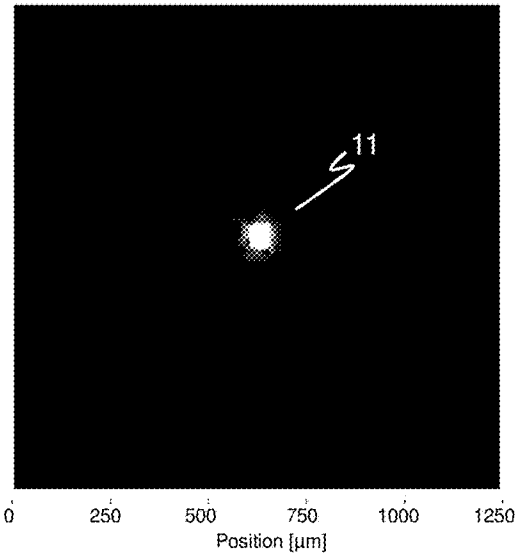
FIG. 5 illustrates a laser light spot.

FIG. 5 shows, by way of example, a laser light spot 11 as seen by a camera 10 in FIG. 4. For this purpose, a non-converting, merely strongly scattering surface was illuminated.

Figure 6:
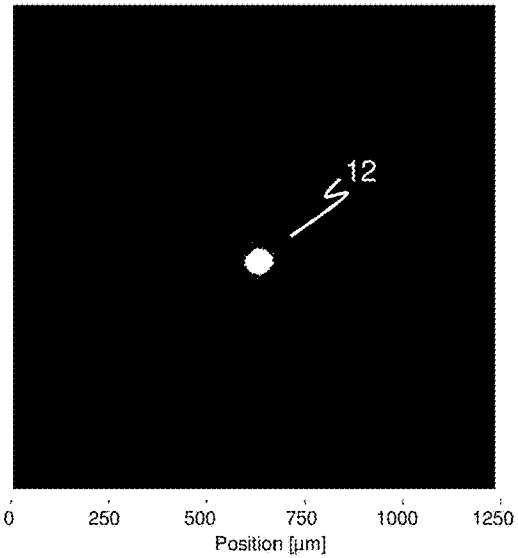
FIG. 6 illustrates a primary emission light spot.

FIG. 6 shows, by way of example, a primary emission light spot 12 on a conversion element as seen by a camera 10 in FIG. 4 if wavelengths greater than that of the laser wavelength are blanked out and illumination is the same as in FIG. 5.

Figure 7:
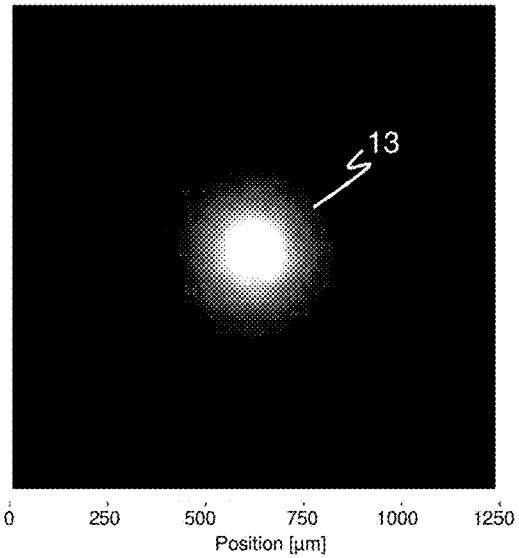
FIG. 7 illustrates a secondary emission light spot.

FIG. 7 shows, by way of example, a secondary emission light spot 13 on the same conversion element as in FIG. 6 as seen by a camera 10 in FIG. 4 if wavelengths smaller than the emission wavelengths are blanked out and illumination is the same as in FIGS. 5 and 6.

As is apparent from a comparison of the respective light spots of FIGS. 5, 6, and 7, the secondary emission light spot 13 is in particular significantly larger than the laser light spot 11 and the primary emission light spot 12.

Also, the primary emission light spot 12 is larger than the laser light spot 11, which however cannot be illustrated with sufficient resolution due to the different surfaces used for the views of FIGS. 5 and 6 and the rather small difference in the dimensions of light spots 11 and 12.

Figure 8:
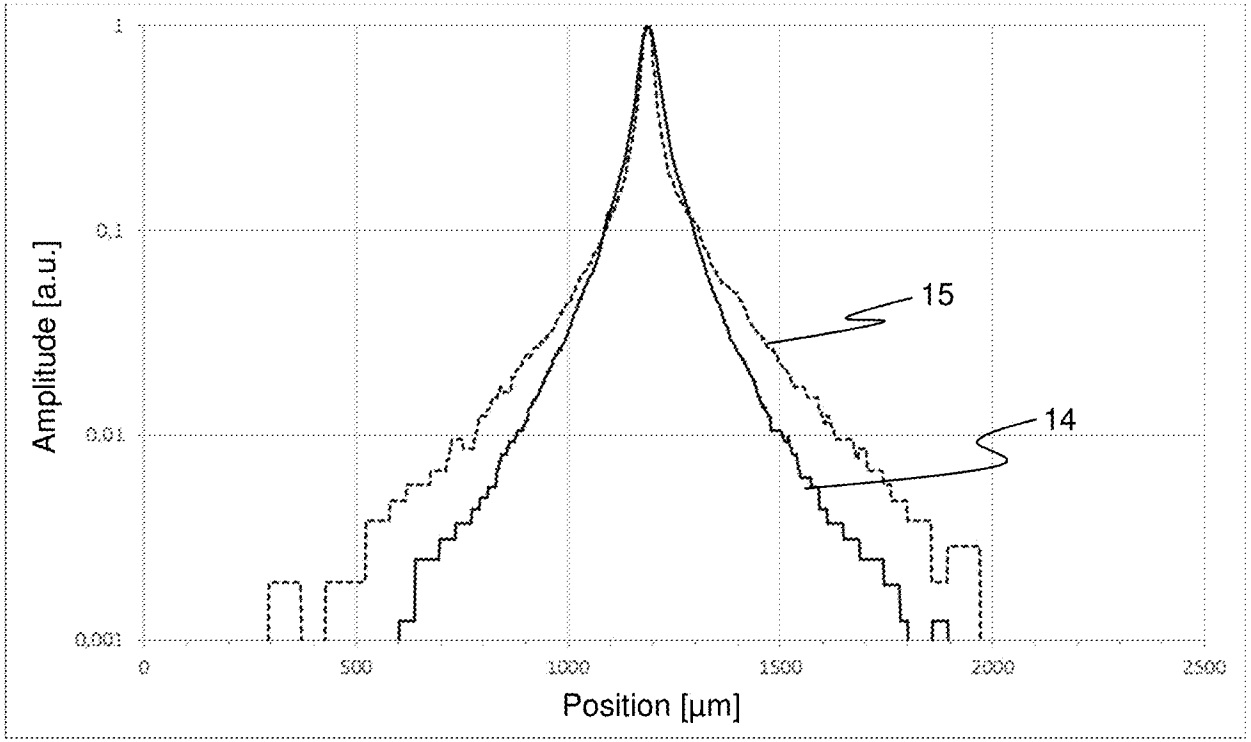
FIG. 8 illustrates intensity profiles of the secondary emission light spot with similar laser irradiation, but with materials differing (only) with respect to the scattering coefficients s.

FIG. 8 shows, by way of example, the intensity profiles 14 and 15 of the converted light (i.e. the intensity of the respective secondary emission light spot). Intensity profile 14 is of a material having the same absorption coefficient a, but twice the scattering coefficient s compared to the material of intensity profile 15. In both cases, the material is a YAG:Ce ceramic.

Figure 9:
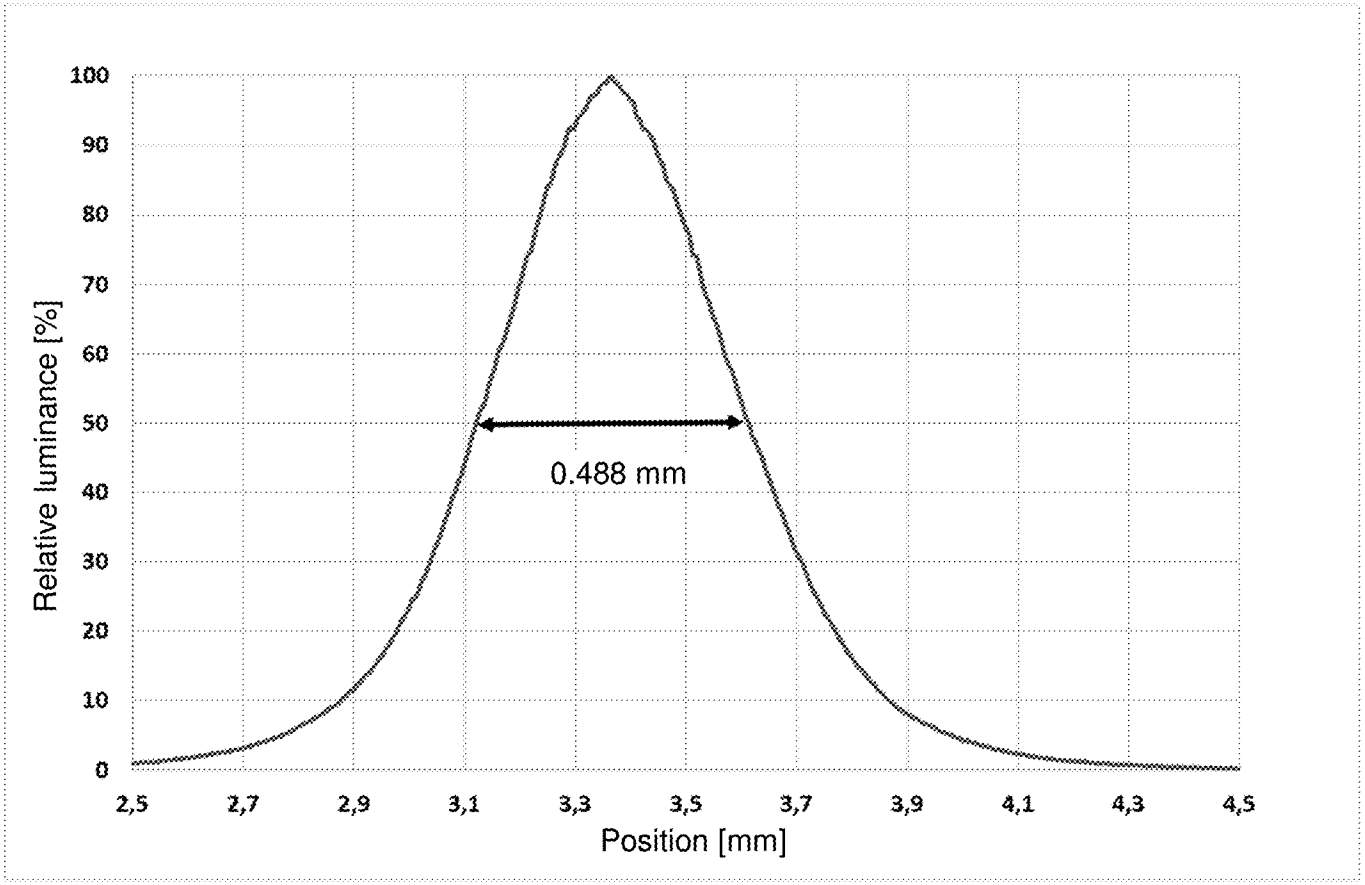
FIG. 9 illustrates the luminance distribution of a laser light spot with an FWHM of 488 μm.

FIG. 9 shows the relative luminance distribution over a laser light spot with 488 μm FWHM on a ceramic conversion element made of $(Y,Gd)_3Al_5O_{12}$:Ce at a laser wavelength of 443 nm and laser light power of 2.7 W.

Figure 10:
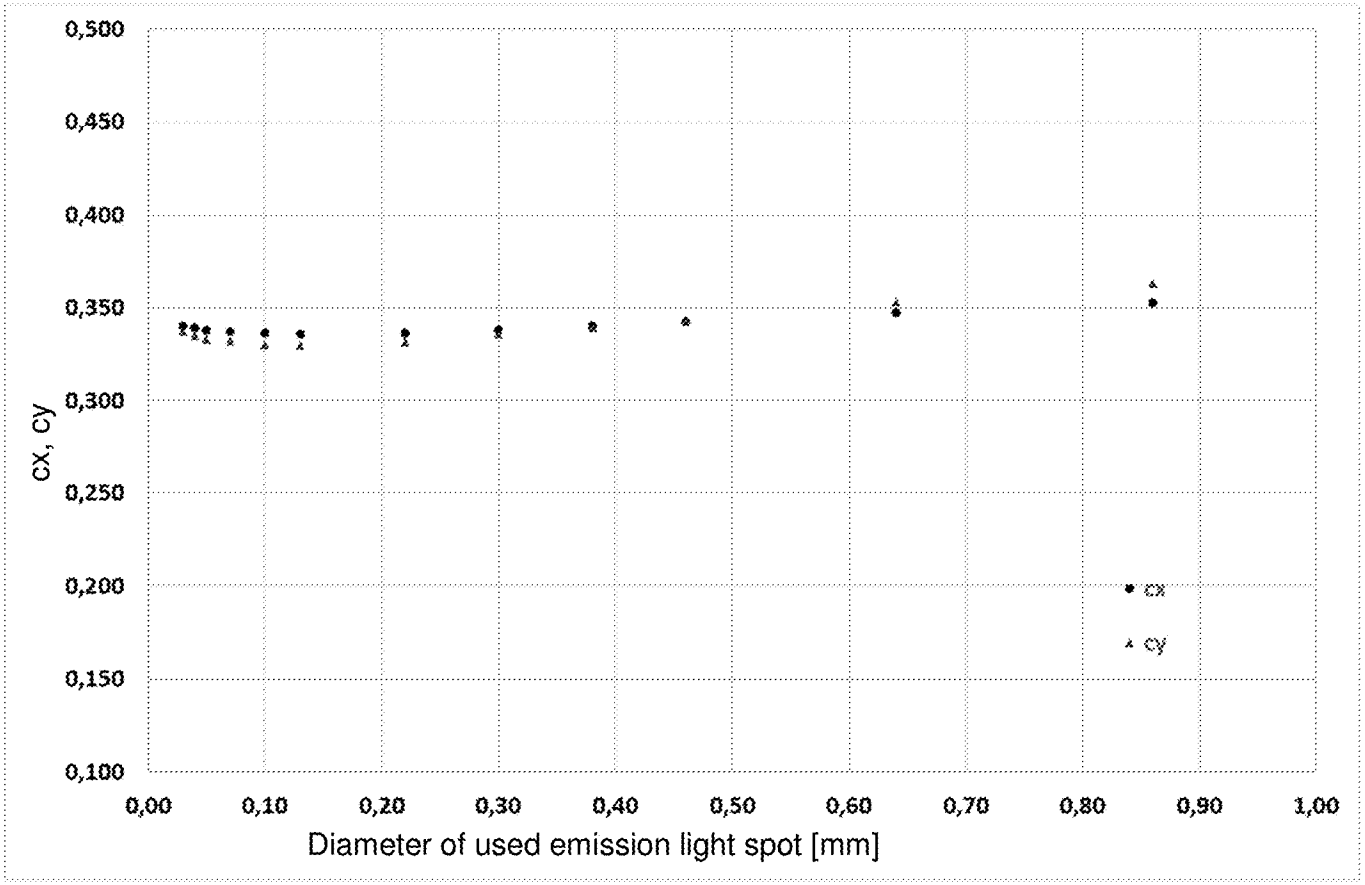
FIG. 10 illustrates the dependence of the color location cx, cy in the case of used light spots of different diameters for the case of the laser light spot of FIG. 9.
Figure 11:
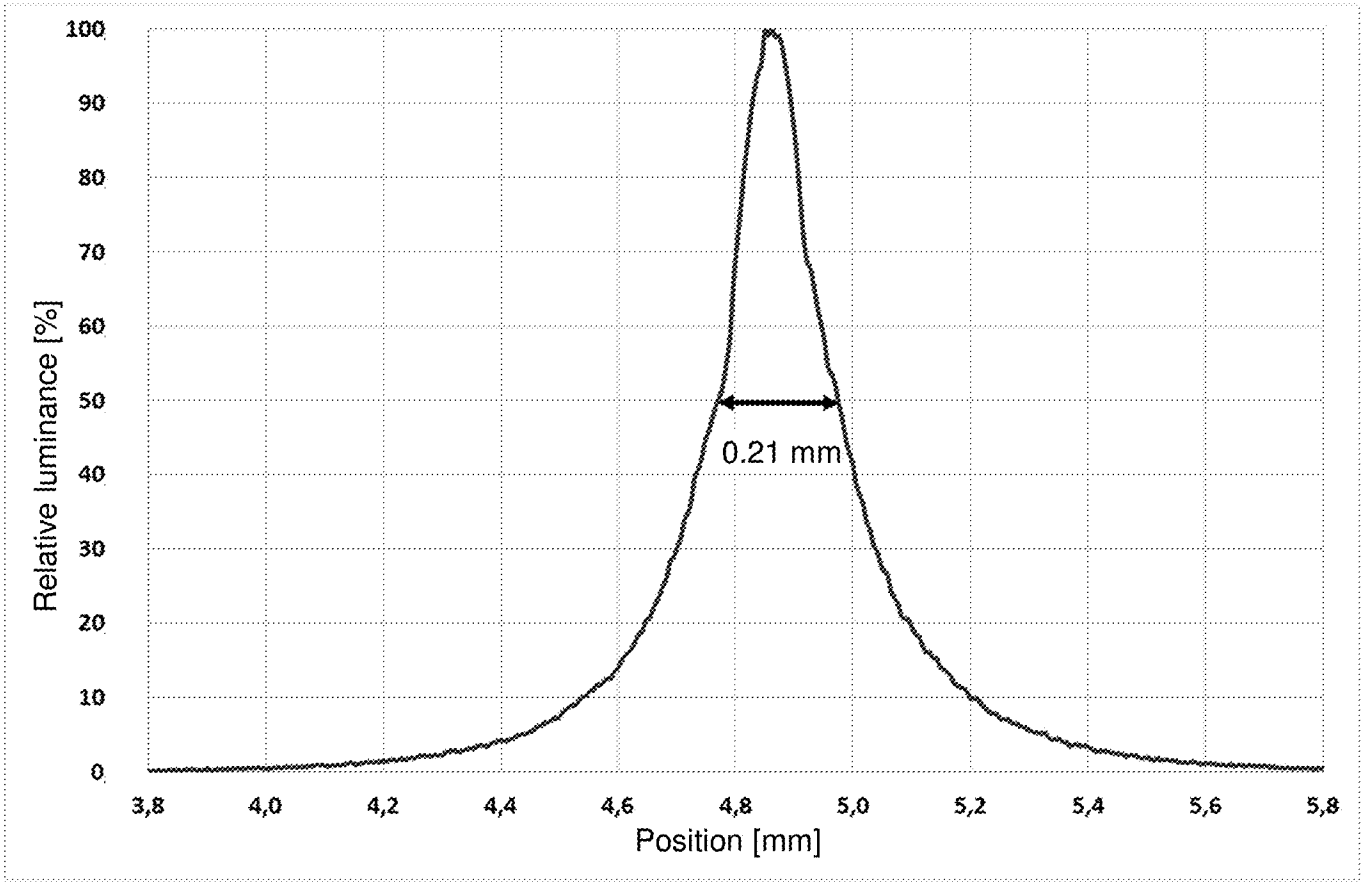
FIG. 11 illustrates the luminance distribution of a laser light spot with an FWHM of 210 μm.
Figure 12:
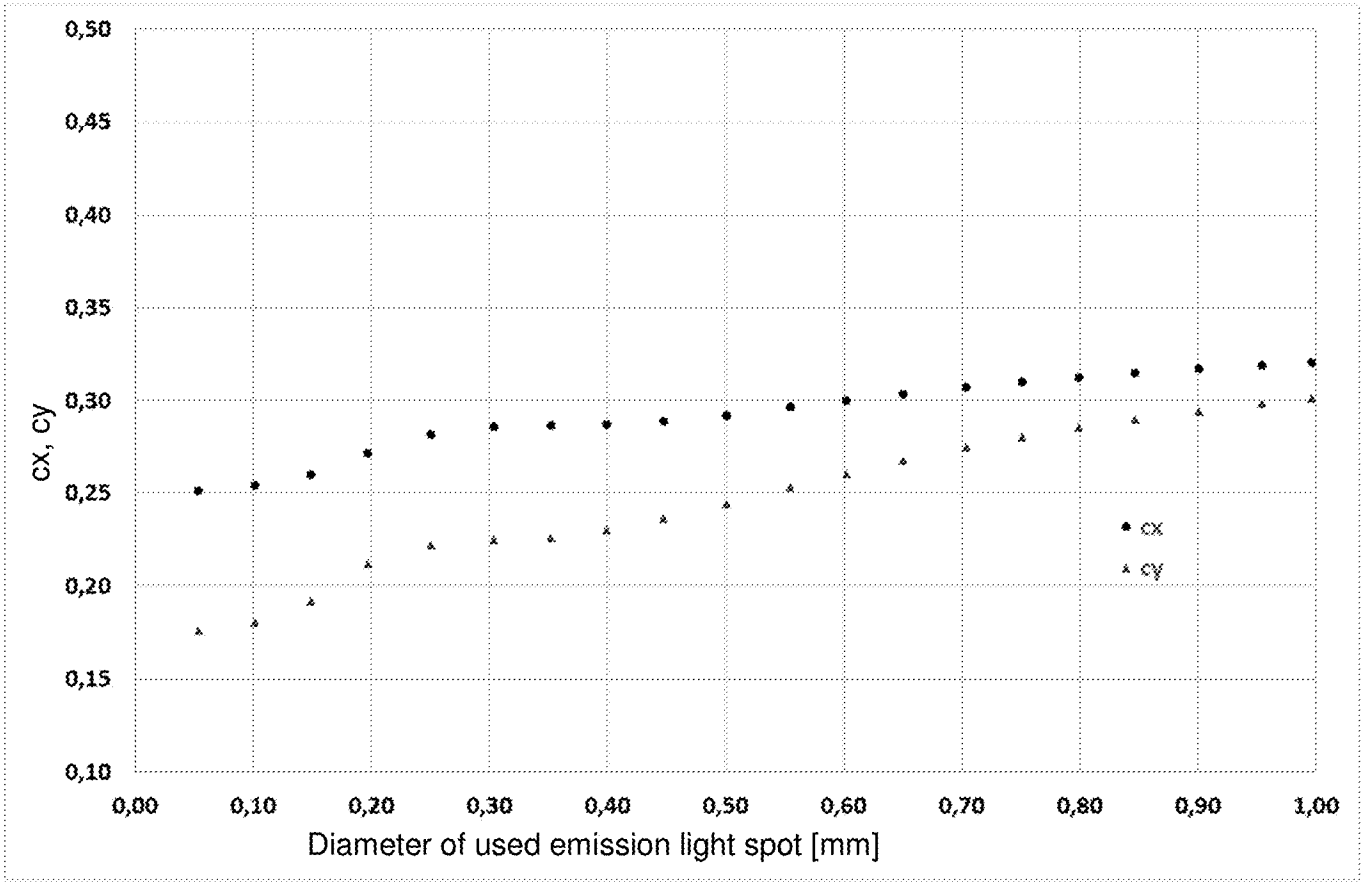
FIG. 12 illustrates the dependence of the color location cx, cy in the case of used light spots of different diameters for the case of the laser light spot of FIG. 11.

FIG. 10 shows the color coordinates cx and cy of the converted emitted light resulting under this illumination for used light spots of different diameters located centrally within the laser light spot. With decreasing diameter of the used light spot, cx and cy decrease slightly. By contrast, the effect is much more pronounced in the case of a laser light spot (same material, same wavelength, same power) with a smaller laser light spot as illustrated in FIG. 11 (FIG. 11: FWHM=210 μm). With decreasing diameter of the used light spot, cx and cy shift significantly from yellow-green towards blue, as is apparent from the data in FIG. 12.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SIGNS

A Dimension of laser light spot
B Dimension of primary emission light spot
C Dimension of secondary emission light spot
D Dimension of used light spot
1 Light beam/incident light
2 Remitted light
3 Converted light
4 Light conversion element
51 Beam portion relevant for illumination optics
52 Loss portion
6 Intensity profile of converted light
7 Intensity profile of remitted light
8 Mirror plate
9 Dichroic filter
10 RGB camera
11 Laser light spot
12 Primary emission light spot
13 Secondary emission light spot
14 Intensity profile of converted light, material has twice the scattering coefficient but the same absorption coefficient as the material of 15
15 Intensity profile of converted light

What is claimed is:

1. A lighting device, comprising:

at least one laser light source configured to emit a light beam; and a light conversion element associated with the at least one laser light source and arranged in a beam path of at least one light beam generated by the at least one laser light source such that at least a portion of the light beam emitted by the at least one laser light source is directed onto the light conversion element, and in such a way that a laser light spot is illuminated on a face of the light conversion element facing an incident light beam, the light conversion element comprising a material which, through scattering, absorption and conversion of the incident light beam, emits and scatters light of a larger wavelength, wherein a primary emission light spot of light having the same wavelength as a wavelength of the incident light beam is produced on the face of the light conversion element facing the incident light beam, the primary emission light spot being larger than the laser light spot, and a secondary emission light spot of light having a larger wavelength, the secondary emission light spot being larger than the primary emission light spot, wherein a used light spot that is exploited for the lighting device comprises only a portion of the secondary emission light spot.

2. The lighting device of claim 1, wherein the laser light spot illuminated by the incident light beam on the light conversion element has a dimension of at least 5 μm and at most 1000 μm, wherein a ratio of dimensions of the secondary emission light spot to the primary emission light spot is between 1.1 and 10.

3. The lighting device of claim 1, wherein a dimension of the used light spot exploited for the lighting device is greater than a dimension of the primary emission light spot and at the same time smaller than a dimension of the secondary emission light spot.

4. The lighting device of claim 1, wherein a color location of the used light has coordinates cx and cy within an area enclosed by the following points:

| cx | cy |
|---|---|
| 0.310 | 0.348 |
| 0.310 | 0.382 |
| 0.443 | 0.382 |
| 0.500 | 0.440 |
| 0.500 | 0.440 |

-continued

| cx | cy |
|---|---|
| 0.443 | 0.348 |
| 0.310 | 0.332. |

5. The lighting device of claim 1, wherein a color temperature of the used light is between 1500 K and 10,000 K.

6. The lighting device of claim 1, wherein:

the laser light source is a laser diode with a power of 0.1 watts to 10 watts; or the laser light source comprises an arrangement of a plurality of laser diodes, whose laser light is entirely or partially bundled by an optical device.

7. The lighting device of claim 6, wherein the light of one or more laser diodes is divided, by an optical device, into a plurality of laser beams which are incident on the light conversion element from different directions and together produce the laser light spot there.

8. The lighting device of claim 1, wherein radiation that is incident on the conversion element within the laser light spot has a radiation power from 0.1 W to 1000 W.

9. The lighting device of claim 1, wherein radiation that is incident on the conversion element within the laser light spot has an intensity from 0.1 $W/mm^2$ to 500 $W/mm^2$.

10. The lighting device of claim 1, wherein the light conversion element has a thickness from at least 10 um to at most 1000 um.

11. The lighting device of claim 1, wherein the at least one laser light source emits electromagnetic radiation of a wavelength within the range between at least 380 nm and at most 470 nm.

12. The lighting device of claim 1, wherein the light conversion element has an absorption coefficient a for the laser light of at least 10 $cm^{-1}$, and has a scattering coefficient s for the laser light between 5 $cm^{-1}$ and 500 $cm^{-1}$.

13. The lighting device of claim 12, wherein the light conversion element has an absorption coefficient a for converted light of less than 10 $cm^{-1}$ and a scattering coefficient s for the converted light of more than 20 $cm^{-1}$.

14. The lighting device of claim 1, wherein the light conversion element comprises or consists of a luminescent ceramic material.

15. The lighting device of claim 14, wherein the light conversion element comprises at least 50 wt % of a garnet-like material as the luminescent ceramic material.

16. The lighting device of claim 15, wherein the garnet-like material has the following molecular formula: $A_3B_5O_{12}$: RE, wherein A comprises at least one of Y, Gd, or Lu, B comprises at least one of Al or Ga, and RE comprises at least one rare-earth element.

17. The lighting device of claim 16, wherein the garnet-like material has at least one of the following molecular formulas:

$$(Y_{1-x}Ce_x)_3Al_5O_{12};$$

$$(Y_{1-x-y}Gd_yCe_x)_3Al_5O_{12};$$

$$(Lu_{1-x}Ce_x)_3Al_5O_{12}; \text{ or}$$

$$(Y_{1-x-z}Lu_zCe_x)_3Al_5O_{12}, \text{ wherein } 0.005<x<0.05, 0<y<0.2, \text{ and } 0<z<1.$$

18. The lighting device of claim 14, wherein the light conversion element is in the form of a porous sintered ceramic having a porosity between 0.5% and 10%, the porosity being based on the volume, wherein an average pore size is between 400 μm and 1200 μm.

19. The lighting device of claim 1, wherein the light conversion element comprises at least 50 wt % of a luminescent ceramic material, wherein the light conversion element is in the form of at least one of:

a single-phase solid ceramic;

a multi-phase solid ceramic;

a single-phase or multi-phase ceramic of a porosity; or a composite material.

20. A method of adjusting a color location or a color temperature of a lighting device, comprising the steps of:

providing a lighting device that comprises at least one laser light source, a light conversion element associated with the at least one laser light source, and optics forming and directing laser radiation onto the light conversion element, wherein the light conversion element is arranged in a beam path of a light beam generated by the at least one laser light source;

generating at least one light beam emitted by the at least one laser light source;

directing at least a portion of the at least one light beam generated by the laser light source onto the light conversion element such that a laser light spot as an image of a portion of the light beam emitted by the laser light source and directed to the light conversion element is illuminated on a face of the light conversion element facing an incident light beam, wherein the laser light spot has a dimension of at least 5 μm and at most 1000 μm, wherein a portion of the incident laser light is backscattered by the light conversion element without undergoing conversion so that a primary emission light spot of light having the same wavelength or color as the laser light is produced on the face of the light conversion element facing the incident light beam, which primary emission light spot is larger than the laser light spot, wherein the light conversion element partially converts the light emitted by the laser light source into light of a longer wavelength such that a secondary emission light spot of a larger wavelength is produced on the face of the light conversion element facing the incident light beam, which secondary emission light spot is larger than the primary emission light spot;

generating a light image by the primary emission light spot and the secondary emission light spot by directing a portion of radiation emitted by the primary emission light spot and the secondary emission light spot onto at least one of at least one optical element or at least one optical component, wherein a selected used light spot is smaller than the secondary emission light spot;

determining an integral color location or color temperature for a selected portion of the light image produced by at least one of the at least one optical element or the at least one optical component or of a selected light bundle; and adjusting the color location by at least one of:

(a) adjusting a primary luminance distribution and a secondary luminance distribution of the emission light spot resulting on the light conversion element through the size of the laser light spot produced by at least a portion of the at least one light beam emitted by the at least one laser light source;

(b) adjusting a primary luminance distribution and a secondary luminance distribution of the emission light spot resulting on the light conversion element by adapting absorption and scattering properties of the material of the conversion element;

(c) adjusting an imaged area portion of the emission light spot by adapting downstream imaging optics; or (d) selecting an illuminated portion of the considered light beam by partial blanking downstream of imaging optics.

* * * * *